US006170272B1

(12) United States Patent
Backman

(10) Patent No.: US 6,170,272 B1
(45) **Date of Patent: *Jan. 9, 2001**

(54) REFRIGERATION SYSTEM WITH INERTIAL SUBCOOLING

(75) Inventor: Thomas John Backman, Morehead City, NC (US)

(73) Assignee: Systematic Refrigeration, Inc., Dayton, MN (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/302,086

(22) Filed: Apr. 29, 1999

(51) Int. Cl.[7] ..... F25B 41/04

(52) U.S. Cl. ..... 62/117; 62/278; 62/335; 62/509; 62/196.4; 62/DIG. 2

(58) Field of Search ..... 62/117, 113, 509, 62/506, 507, 175, 335, 428, 196.4, 513, 81, 278, DIG. 2, DIG. 17

(56) References Cited

U.S. PATENT DOCUMENTS 3,427,819 * 2/1969 Seghetti ..... 62/509 X
3,852,974 * 12/1974 Brown ..... 62/335 X
4,324,106 * 4/1982 Ross et al. ..... 62/509 X
5,079,929 * 1/1992 Alsenz ..... 62/117
5,386,709 2/1995 Aaron ..... 62/199
5,729,993 3/1998 Boiarski et al. ..... 62/175
5,867,993 2/1999 Dube ..... 62/81

* cited by examiner

*Primary Examiner*—Harry B. Tanner
(74) *Attorney, Agent, or Firm*—Merchant & Gould P.C.

(57) ABSTRACT

The present disclosure relates to a refrigeration system including a compressor for compressing a refrigerant, a condenser in fluid communication with the compressor for condensing compressed refrigerant received from the compressor, and a reservoir in fluid communication with the condenser for holding condensed refrigerant received from the condenser. The system also includes a heat exchanger in fluid communication with the reservoir, an expansion device in fluid communication with the heat exchanger for decompressing cooled refrigerant received from the heat exchanger, and at least one evaporator in fluid communication with the expansion device for evaporating decompressed refrigerant received from the expansion device. The refrigeration system further includes a suction line for providing fluid communication between the compressor and the evaporator, and a recirculation line for recirculating cooled refrigerant from the heat exchanger back to the reservoir to pre-cool the condensed refrigerant held within the reservoir. The pre-cooled refrigerant is conveyed from the reservoir to the heat exchanger to be further cooled.

22 Claims, 5 Drawing Sheets

REFRIGERATION SYSTEM WITH INERTIAL SUBCOOLING

FIELD OF THE INVENTION

The present invention relates generally to refrigeration systems. More specifically, the present invention relates to direct expansion refrigeration systems having secondary subcooling.

BACKGROUND OF THE INVENTION

A simple refrigeration system includes a compressor (e.g., a single compressor or multiple compressors arranged in parallel), a condenser, an expansion valve, and an evaporator which are interconnected by a plurality of pipes. The compressor moves a refrigerant (e.g., a gaseous refrigerant such as HFC404, HCFC22, or the like) through the system. Typically, the refrigerant exits the compressor as a high-pressure vapor. From the compressor, the high-pressure vapor flows to the condenser. At the condenser, the high-pressure vapor condenses back to a liquid thereby giving off heat that is removed from the system. From the condenser, the condensed refrigerant is conveyed to the expansion valve which decompresses the refrigerant. The decompressed refrigerant is conveyed to the evaporator where the refrigerant transitions to a vapor. The evaporator is typically located within an area desired to be refrigerated (e.g., a refrigeration case). As the refrigerant is evaporated within the evaporator, the temperature within the evaporator drops thereby causing heat from the area desired to be refrigerated to flow into the evaporator. In this manner, the evaporator performs a cooling function. From the evaporator, the refrigerant is circulated back to the compressor and the cycle is repeated.

Refrigeration systems operate more efficiently if the refrigerant exiting the condenser is cooled prior to being evaporated. Commonly, the refrigerant of a primary refrigeration system is cooled by using a secondary refrigeration system. This type of cooling is frequently referred to as "mechanical subcooling." If the secondary refrigeration system operates more efficiently than the primary system, there is an efficiency gain. This type of design is used often in commercial refrigeration systems for providing efficiency gain and for ensuring a solid column of refrigerant at the expansion device.

FIG. 1 illustrates a prior art refrigeration system 20 having mechanical subcooling. The refrigeration system 20 includes a primary system 22 and a secondary system 24. The primary system 22 interfaces with the secondary system 24 at a heat exchanger 26. At the heat exchanger 26, the secondary system 24 is used to subcool the refrigerant of the primary system 22.

The secondary system 24 includes a secondary compressor 28, a secondary condenser 30, a secondary expansion valve 32 and a secondary evaporator 34. The secondary evaporator 34 is positioned within the heat exchanger 26 and functions to subcool the refrigerant of the primary system 22.

The primary system 22 includes a primary compressor 36, a primary condenser 38, a receiver 40, a primary expansion valve 42, and a primary evaporator 44. FIG. 1 shows the refrigeration system 20 under normal operating conditions. At normal operating conditions, pressurized refrigerant vapor from the primary compressor 36 is condensed at the primary condenser 38. Condensed refrigerant from the primary condenser 38 is held within the receiver 40. From the receiver 40, the refrigerant flows through the heat exchanger 26 where the refrigerant is cooled. The cooled refrigerant is then conveyed to the primary expansion valve 42 where the refrigerant is decompressed. A liquid pump 43 adds pressure to the cooled refrigerant to prevent any flashing of the refrigerant to a vapor before reaching the primary expansion valve 42. Decompressed refrigerant from the primary expansion valve 42 is conveyed through the primary evaporator 44 where the refrigerant transitions to a vapor. The primary evaporator 44 is located within a region 48 desired to be cooled, and the evaporated refrigerant draws heat from the region 48. After exiting the primary evaporator 44, the refrigerant is cycled back to the primary compressor 36 and the sequence is repeated.

A problem with refrigeration systems such as the refrigeration system of FIG. 1 is the accumulation of ice within the evaporator (e.g., on the evaporator coils). To overcome this problem, most refrigeration systems periodically use a defrost cycle to melt ice accumulation within the evaporator. For example, one type of refrigeration defrost technique involves interrupting refrigerant flow through the evaporator. Another type of refrigeration defrost technique involves interrupting refrigerant flow through the evaporator in combination with resistance heating.

FIG. 2 shows a defrost cycle that uses hot gas from the compressor 36 to defrost the evaporator 44. In the defrost cycle, valve 50 is used to close fluid communication between the primary evaporator 44 and the intake of the primary compressor 36. Valve 52 opens fluid communication between the outlet side of the primary compressor 36 and the primary evaporator 44. In this manner, relatively hot defrost gas from the primary compressor 36 is pumped through suction line 54 and flows in a reverse direction through the primary evaporator 44. As the hot defrost gas flows through the primary evaporator 44, ice within the primary evaporator 44 is melted thereby cooling and condensing the defrost gas. The condensed refrigerant exits the primary evaporator 44 and bypasses the primary expansion valve 42 through bypass line 56. Bypass line 56 includes a one-way check valve 58 that allows refrigerant from the primary evaporator 44 to bypass the primary expansion valve 42, but prevents flow in an opposite direction. After bypassing the primary expansion valve 42, the refrigerant flows through solenoid valve 60 to return line 62. The return line 62 conveys the refrigerant back to the receiver 40. During the defrost cycle, the valve 60 closes fluid communication between the liquid pump 43 and the expansion valve 42.

SUMMARY OF THE INVENTION

One aspect of the present invention relates a refrigeration system including a compressor for compressing a refrigerant, a condenser in fluid communication with the compressor for condensing compressed refrigerant received from the compressor, and a reservoir in fluid communication with the condenser for holding condensed refrigerant received from the condenser. The system also includes a heat exchanger in fluid communication with the reservoir, an expansion device in fluid communication with the heat exchanger for decompressing cooled refrigerant received from the heat exchanger, and at least one evaporator in fluid communication with the expansion device for evaporating decompressed refrigerant received from the expansion device. The system further includes a suction line for providing fluid communication between the compressor and the evaporator, and a recirculation line for recirculating cooled refrigerant from the heat exchanger back to the reservoir to pre-cool the condensed refrigerant held within the reservoir. The pre-cooled refrigerant is conveyed from the reservoir to the heat exchanger to be further cooled. By pre-cooling the refrigerant mass kept in the reservoir, the mass of refrigerant in the reservoir creates a thermal fly wheel that dampens temperature variations of refrigerant liquid leaving the heat exchanger.

Another aspect of the present invention relates to a method for damping temperature fluctuations in a refrigeration system. The refrigeration system includes a compressor, a condenser, a reservoir, a heat exchanger, an expansion device and an evaporator. The method includes compressing a refrigerant at the compressor, conveying the refrigerant from the compressor to the condenser, and condensing the refrigerant at the condenser. The method also includes conveying the refrigerant from the condenser to the reservoir, conveying the refrigerant from the reservoir to the heat exchanger, and cooling the refrigerant at the heat exchanger to provide a cooled refrigerant. The method further includes recirculating a first portion of the cooled refrigerant back to the reservoir, and conveying a second portion of the cooled refrigerant through the expansion device and the evaporator to the compressor.

A variety of advantages of the invention will be set forth in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several aspects of the invention and together with the description, serve to explain the principles of the invention. A brief description of the drawings is as follows.

DETAILED DESCRIPTION

Reference will now be made in detail to exemplary aspects of the present invention that are illustrated in the accompanying drawings. Wherever possible, the same reference numbers will be used throughout the drawings to refer to the same or like parts.

Figure 1:
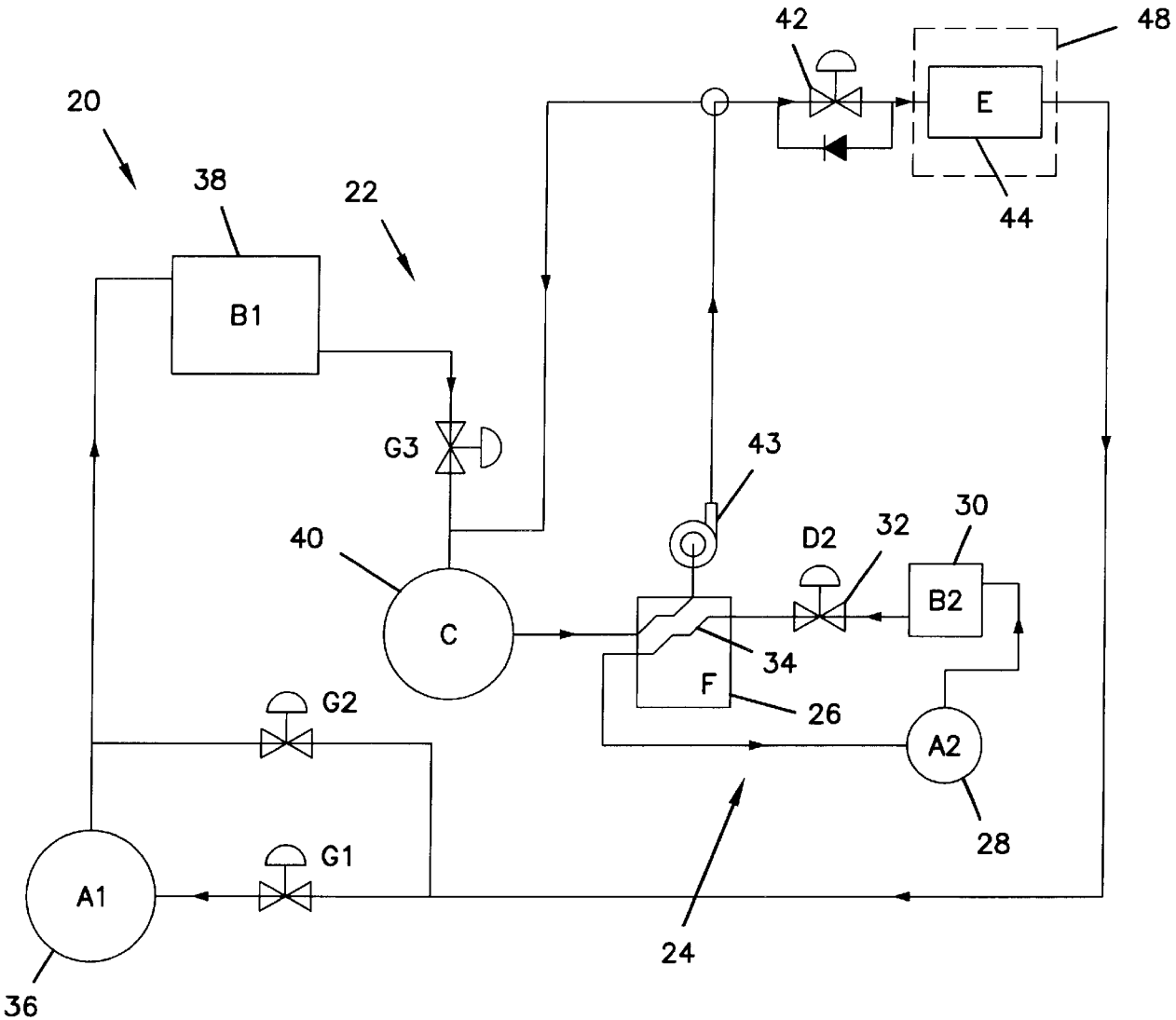
FIG. 1 PRIOR ART
FIG. 1 illustrates a prior art refrigeration system in a normal operating condition.
Figure 2:
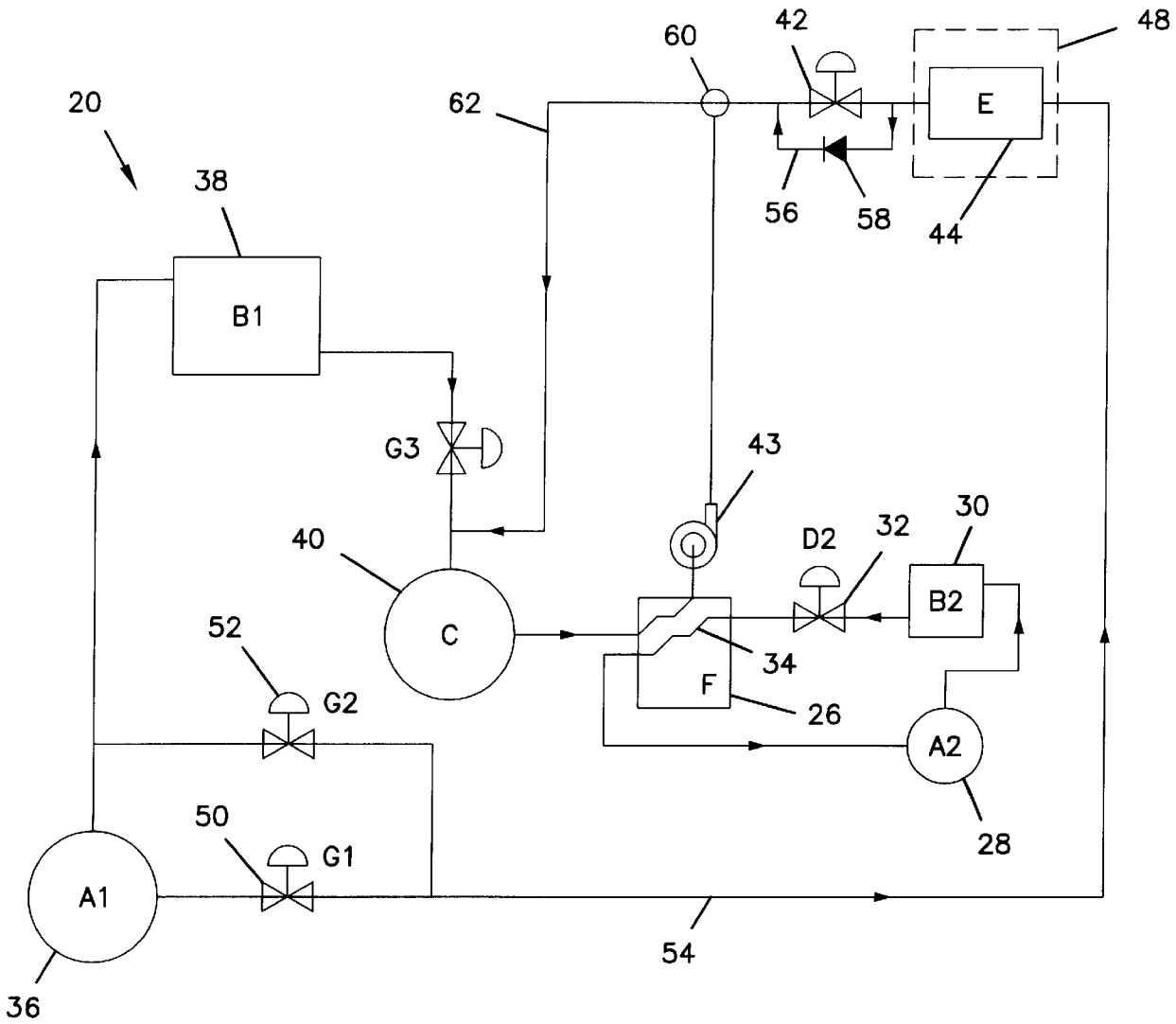
FIG. 2 (PRIOR ART)
FIG. 2 illustrates the prior art refrigeration system of FIG. 1 in a defrost cycle.

Referring back to FIGS. 1 and 2, the refrigerant of the primary system 20 is cooled by a "one-time" pass through the heat exchanger 26. This "one-time" pass through the heat exchanger 26 has a tendency to cool the primary system refrigerant erratically. For example, the cooled refrigerant temperature increases or decreases with dynamic changes in the primary system 22 and the secondary system 24. Pressure regulators, multiple expansion devices and electronic controllers have failed to effectively dampen such temperature fluctuations. The present invention relates to a solution for damping temperature fluctuations in a refrigeration system.

One broad aspect of the present invention relates to damping temperature fluctuations by recirculating portions of cooled refrigerant from a heat exchanger back through the heat exchanger. Another broad aspect of the present invention relates to damping temperature fluctuations by recirculating a cooled refrigerant from a heat exchanger back to a receiver located upstream from the heat exchanger. In this way, a mass of refrigerant in the receiver is pre-cooled and creates a thermal fly wheel that dampens fluctuating temperatures of the cooled refrigerant leaving the heat exchanger.

Figure 3:
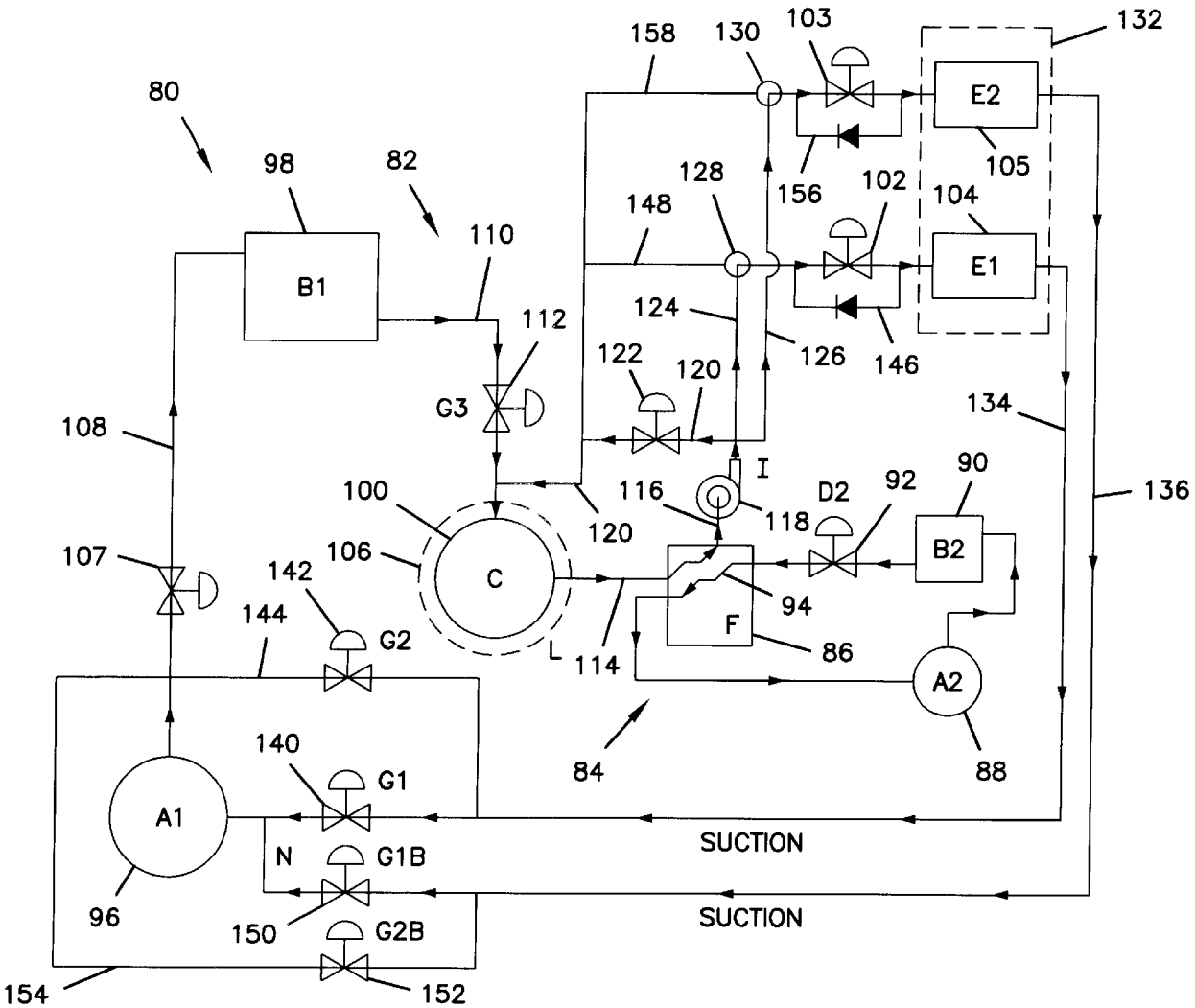
FIG. 3 illustrates a refrigeration system constructed in accordance with the principles of the present invention, the refrigeration system is shown under normal operating conditions.
Figure 4:
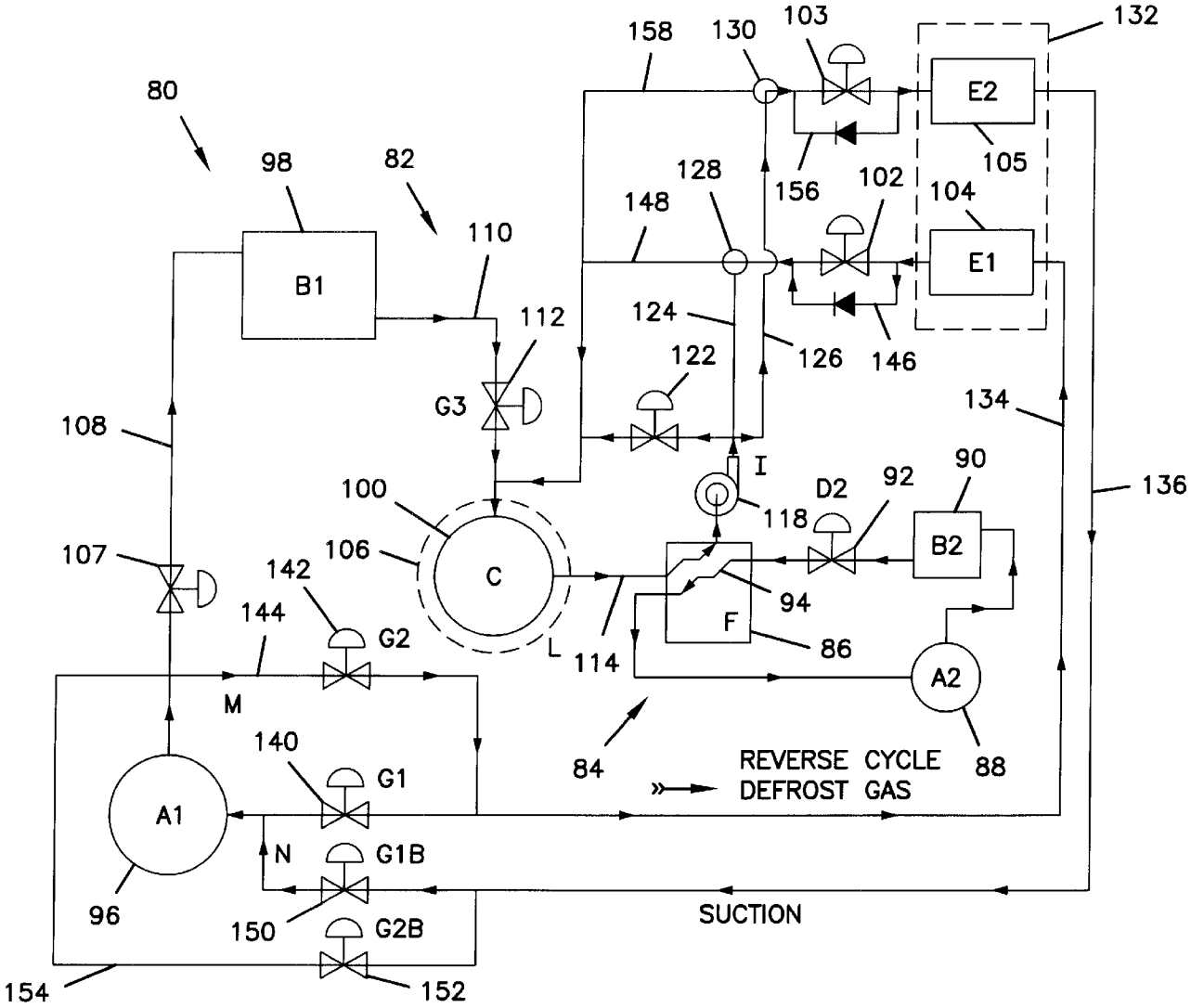
FIG. 4 illustrates the refrigeration system of FIG. 3 with one of the evaporators in a defrost cycle.
Figure 5:
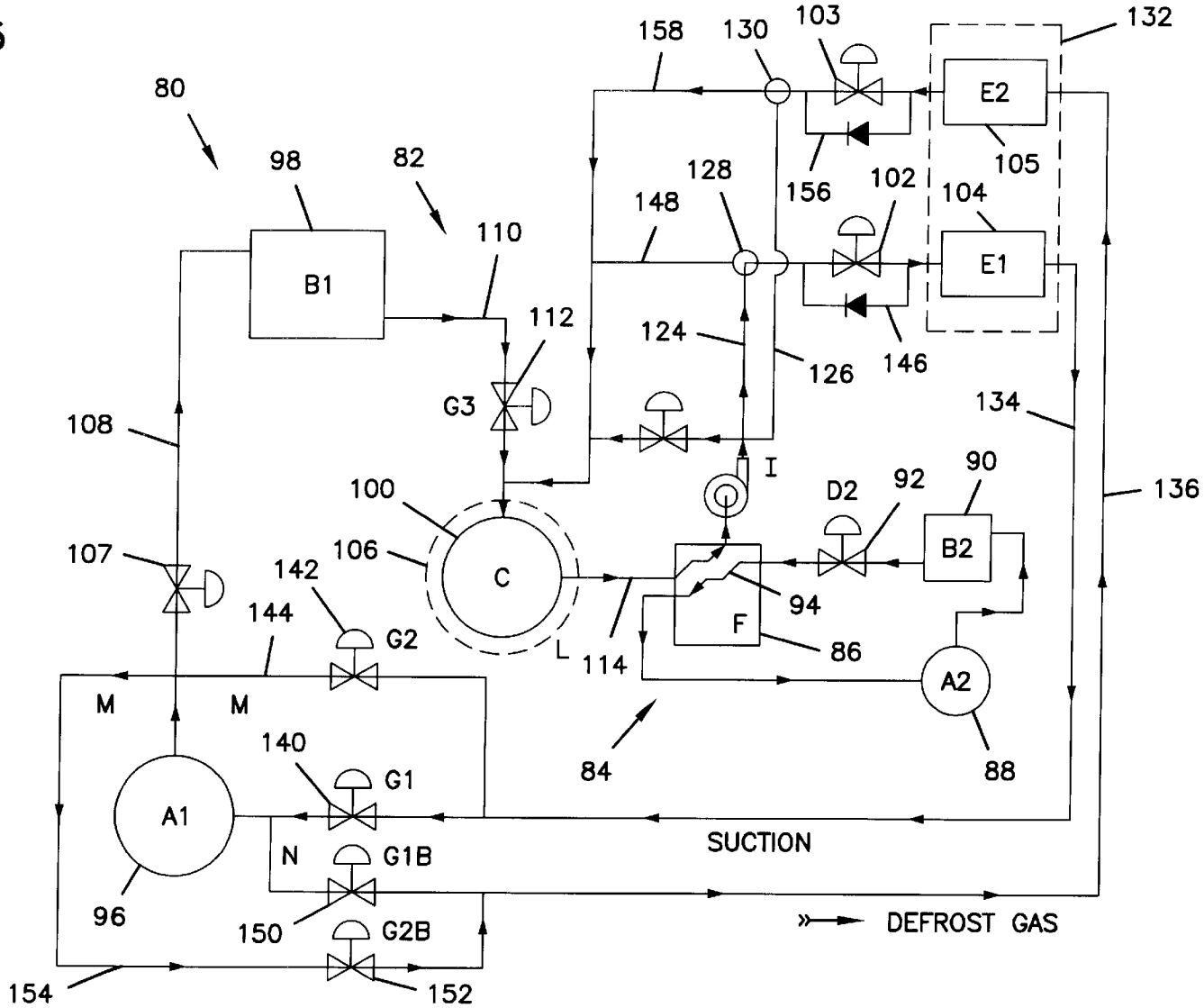
FIG. 5 illustrates the refrigeration system of FIG. 3 with the other of the evaporators in a defrost cycle.

FIGS. 3–5 schematically illustrate a refrigeration system 80 constructed in accordance with the principles of the present invention. Generally, the refrigeration system 80 includes a primary refrigeration system 82 and a secondary refrigeration system 84. The primary and secondary refrigeration systems 82 and 84 interface at a heat exchanger 86. The heat exchanger 86 preferably has a conventional design. For example, the heat exchanger 86 may have a shell and tube design, a plate-to-plate design, a coaxial design, or the like. Furthermore, while it is preferred for the heat exchanger 86 to utilize a secondary direct expansion refrigeration system for cooling, it will be appreciated that any type of apparatus for cooling refrigerant within the primary system 82 can be used.

The secondary refrigeration system 84 includes a secondary compressor 88, a secondary condenser 90, a secondary expansion device or valve 92, and an evaporator 94. A refrigerant is circulated through the various components of the secondary refrigeration system 84. Refrigerant gas from the compressor 88 is condensed at the condenser 90. The condensed refrigerant is decompressed at the expansion valve 92 and evaporated at the evaporator 94. The evaporator 94 is located within the heat exchanger 86 and is positioned to draw heat from refrigerant of the primary refrigeration system 82. Refrigerant exiting the evaporator 94 is suctioned back to the compressor 88 and then recycled back through the system 84.

The primary refrigeration system 82 includes a primary compressor 96, a primary condenser 98, a reservoir or receiver 100, first and second expansion devices 102 and 103, and first and second evaporators 104 and 105. It will be appreciated that the primary compressor 96, the condenser 98, the expansion devices 102 and 103, and the evaporators 104 and 105 have conventional configurations. For example, the compressor 96 can comprise a conventional screw compressor, reciprocating compressor or the like. A single compressor or multiple compressors arranged in parallel can be used. Similarly, multiple condensers (e.g., condensers arranged in parallel) can also be used.

The expansion devices 102 and 103 can comprise conventional expansion valves or any other device suitable for decompressing or depressuring a refrigerant liquid. In certain embodiments, the condenser 98 can have tubing arranged in a conventional serpentine coil configuration. Air, or a combination of air and water can be blown or sprayed across the coils. Other types of known condenser configurations can also be used such as shell and tube configurations, plate-to plate configurations, coaxial configurations, or the like. While the evaporators 104 and 105 can comprise any type of evaporator, a preferred configuration includes tubing arranged in a conventional serpentine configuration. In certain embodiments, air can be blown across the tubing to enhance heat exchange. While two sets of evaporators and expansion devices arranged in parallel are shown, it will be appreciated that a single set or more than two sets could also be used.

The receiver 100 is preferably a tank used to hold or store refrigerant before the refrigerant is conveyed (e.g., moved, piped or otherwise transported) to the heat exchanger 86. By way of a non-limiting example, the receiver 100 can hold 6 to 15 pounds of refrigerant for each horsepower of the primary compressor 96. To maintain a given temperature within the receiver 100, a layer of thermal insulating material 106 preferably surrounds the receiver 100. By way of non-limiting example, the receiver 100 can be made of a metal material, while the insulating material 106 can be made of a closed-cell insulation (e.g., rubber, foam, polymer, etc.).

FIG. 3 illustrates the refrigeration system 80 in a normal operating condition (i.e., a condition in which neither of the evaporators 104 and 105 is being defrosted). Refrigerant gas is pumped from the primary compressor 96 to the condenser 98 through flow line 108. As used herein, the term "flow line" is intended to mean any type of conduit, piping or tubing suitable for conveying a refrigerant. A discharge differential pressure regulator 107 is positioned along the flow line 108. As will be described later in the specification, the pressure regulator 107 is used to selectively restrict flow through the flow line 108. However, during the normal operating condition, the pressure regulator 107 is wide open and does not restrict flow through flow line 108.

After passing though the pressure regulator 107, the refrigerant gas from flow line 108 is condensed in the primary condenser 98. Condensed refrigerant from the primary condenser 98 flows to the receiver 100 through flow line 110. A restricter valve 112 positioned along flow line 110 assists in controlling the rate of refrigerant flow through the primary condenser 98.

The condensed refrigerant from the primary condenser 98 is temporarily stored in the receiver 100. From the receiver 100, the condensed refrigerant is conveyed to the heat exchanger 86 by flow line 114. As the refrigerant flows through the heat exchanger 86, the refrigerant is cooled by the secondary refrigeration system 84.

The refrigerant of the primary refrigeration system 82 exits the heat exchanger 86 through flow line 116. A liquid pump 118 is positioned along flow line 118. In an alternative embodiment, the pump 118 could also be placed between the receiver 100 and the heat exchanger 86. The liquid pump 118 adds pressure to the refrigerant within line 116 to prevent any flashing of the refrigerant to a vapor before reaching the expansion valves 102 and 103. A recirculation line 120 branches off from line 116 at a location upstream from the liquid pump 118. The recirculation line 120 recirculates a portion of the cooled refrigerant discharged from the heat exchanger 86 back to the receiver 100. As shown in FIG. 3, the recirculation line 120 intersects with line 112 at a location slightly upstream from the receiver 100 such that cooled refrigerant from the recirculation line 120 initially mixes with the condensed refrigerant from the primary condenser 98 at a location upstream from the receiver 100. However, it will be appreciated that in alternative embodiments, the recirculation line 120 can flow directly into the receiver 100.

A pressure differential or regulator valve 122 is positioned along the recirculation line 120. The pressure differential valve 122 restricts flow through the recirculation line 120 to ensure that adequate subcooled refrigerant is provided from the heat exchanger 86 to the evaporators 104 and 105. In other words, the pressure differential valve 122 prevents the subcooled refrigerant discharged from the heat exchanger 86 from short-circuiting through the reservoir 100. It is preferred for the pressure differential valve to be adjustable, with the pressure differential valve 122 capable of being set to a pressure between 2 and 35 pounds above the receiver outlet pressure. Depending upon the load on the system, 5 to 95 percent of the subcooled refrigerant discharged from the heat exchanger 86 is recirculated back to the receiver 100 through the recirculation line 120.

By recirculating subcooled refrigerant from the heat exchanger 86 back to the receiver 100, the refrigerant mass held in the receiver 100 is pre-cooled. In this manner, the mass of pre-cooled refrigerant in the receiver 100, which is conveyed to the heat exchanger 86 for further cooling, creates a thermal fly wheel that dampens temperature variations of the subcooled refrigerant leaving the heat exchanger 86.

Expansion valve flow lines 124 and 126 also branch off from flow line 116. The flow lines 124 and 126 are arranged in parallel, and solenoid valves 128 and 130 respectively control flow through each flow line 124 and 126.

When the refrigeration system 80 is in the normal operating condition of FIG. 3, subcooled refrigerant from the heat exchanger 86 is pumped through the expansion valve flow lines 124 and 126, through solenoid valves 128 and 130, to expansion valves 102 and 103. At the expansion valves 102 and 103, the subcooled refrigerant is decompressed. The decompressed refrigerant is conveyed from the expansion devices 102 and 103 to the evaporators 104 and 105. At the evaporators 102 and 105, the refrigerant evaporates thereby cooling a region desired to be cooled as such as a refrigerator case 132. Refrigerant vapor exiting the evaporators 104 and 105 is respectively conveyed back to the primary compressor 96 through parallel suction lines 134 and 136.

FIG. 4 shows the refrigeration system 80 with the first evaporator 104 in a defrost cycle. To enter the defrost cycle, fluid communication between the first evaporator 104 and the intake of the primary compressor 96 is closed by valve 140. Concurrently, fluid communication between the outlet of the primary compressor 96 and the first evaporator 104 is opened by valve 142. Additionally, the differential pressure regulator 107 restricts flow through flow line 108 to create a differential pressure between the outlet of the primary compressor 96 and the receiver 100.

To defrost the first evaporator 104, hot defrost gas is conveyed from the primary compressor 96 through line 144 to line 134. The defrost gas then flows in a reverse direction through suction line 134 and into the first evaporator 104. As the defrost gas flows through the evaporator 104, the evaporator is defrosted and the defrost gas condenses. The condensed refrigerant then flows around expansion valve 102 through bypass line 146. Next, the refrigerant flows through solenoid valve 128 (which concurrently closes line 124) to return line 148. From return line 148, the refrigerant is conveyed back to the receiver 100. The differential pressure provided by differential pressure valve 107 ensures that hot gas from the primary compressor 96 is encouraged to flow through the evaporator 104 to the receiver 100 to enable the evaporator 104 to be defrosted. After the defrost cycle is complete, valve 142 closes flow line 144, valve 107 stops restricting flow line 108, valve 140 reopens fluid communication between the first evaporator 104 and the intake of the primary compressor 96, and solenoid valve 128 closes line 148 and reopens line 124. While the evaporator 104 is being defrosted, the evaporator 105 continues to operate in a refrigeration cycle, and subcooled refrigerant from the heat exchanger continues to be recirculated back to the receiver 100.

FIG. 5 shows the refrigeration system 80 with the second evaporator 105 in a defrost cycle. In the defrost cycle, valve 150 closes fluid communication between the second evaporator 105 and the intake of the primary compressor 96. Concurrently, valve 152, which controls flow through flow line 154, opens fluid communication between the outlet of the primary compressor 96 and the second evaporator 105. Additionally, the differential pressure regulator 107 restricts flow through flow line 108 to create a differential pressure between the outlet of the primary compressor 96 and the receiver 100.

In the defrost cycle of FIG. 5, hot defrost gas from the compressor flows through flow line 154, back through suction line 136 to the second evaporator 105. As the defrost gas flows back through the second evaporator 105, the evaporator 105 is defrosted and the defrost gas is cooled and condensed. The cooled and condensed refrigerant exits the second evaporator 105 and flows to solenoid valve 130 (which also closes line 126) via bypass line 156. The solenoid valve 130 directs the refrigerant to return line 158 which conveys the refrigerant back to the receiver 100. While the second evaporator 105 is being defrosted, the first evaporator 104 continues to be supplied with subcooled refrigerant, and subcooled refrigerant from the heat exchanger continues to be recirculated back to the receiver 100.

After the defrost cycle has been completed, valve 152 closes flow line 154, valve 107 stops restricting flow line 108, valve 150 opens fluid communication between the second evaporator 105 and the intake of the compressor 96, and solenoid valve 130 closes line 158 and reopens line 126.

During normal operating conditions, it is preferred for the refrigerant temperature at the outlet of the condenser to be at least 5 degrees (F) cooler than the condensing temperature of the refrigerant at the pressure under which the refrigerant is being condensed. Also, by way of non-limiting example, the refrigerant temperature at the outlet of the receiver 100 can be about 5–20 degrees (F) warmer than the temperature of the subcooled refrigerant exiting the heat exchanger 86. For low temperature applications (e.g., freezers, etc.), it is preferred for the subcooled refrigerant exiting the heat exchanger to be about 40 degrees (F). For medium temperature applications (e.g., produce cases, dairy cases, walk-in-storage coolers, etc.), it is preferred for the subcooled refrigerant exiting the heat exchanger to be about 40–60 degrees (F).

With regard to the foregoing description, it is to be understood that changes may be made in detail, especially in matters of the construction materials employed and the size, shape and arrangement of the parts without departing from the 10 scope of the present invention. For example, while hot gas defrost cycles have been shown, it will be appreciated that any type of defrost technique could be used. It is intended that the specification and depicted aspects be considered exemplary only, with a true scope and spirit of the invention being indicated by the broad meaning of the following claims.

What is claimed is:

1. A refrigeration system comprising:

a compressor for compressing a refrigerant;

a condenser in fluid communication with the compressor for condensing compressed refrigerant received from the compressor;

a reservoir in fluid communication with the condenser for holding condensed refrigerant received from the condenser;

a heat exchanger in fluid communication with the reservoir;

an expansion device in fluid communication with the heat exchanger for de-compressing cooled refrigerant received from the heat exchanger;

at least one evaporator in fluid communication with the expansion device for evaporating de-compressed refrigerant received from the expansion device;

a suction line for providing fluid communication between the compressor and the evaporator; and a recirculation line for recirculating cooled refrigerant from the heat exchanger back to the reservoir to pre-cool the condensed refrigerant held within the reservoir, wherein pre-cooled refrigerant is conveyed from the reservoir to the heat exchanger to be further cooled.

2. The refrigeration system of claim 1, wherein the heat exchanger includes a secondary evaporator that is part of a secondary cooling system.

3. The refrigeration system of claim 1, further comprising a layer of thermal insulating material surrounding the reservoir.

4. The refrigeration system of claim 1, wherein a pressure differential valve is positioned along the recirculation line.

5. The refrigeration system of claim 1, wherein an expansion device flow line provides fluid communication between the heat exchanger and the expansion device, and the recirculation line branches off from the expansion device flow line.

6. The refrigeration system of claim 5, further comprising a liquid pump located along the expansion device flow line.

7. The refrigeration system of claim 6, wherein the recirculation line is located upstream from the liquid pump.

8. The refrigeration system of claim 7, wherein a pressure differential valve is positioned along the recirculation line.

9. The refrigeration system of claim 1, wherein the cooled refrigerant from the recirculation line initially mixes with the condensed refrigerant from the condenser at a location upstream from the reservoir.

10. The refrigeration system of claim 1, further comprising a return line for conveying refrigerant from the evaporator to the reservoir during a defrost cycle, the recirculation line including at least a portion that is separate from the return line.

11. The refrigeration system of claim 10, wherein a differential pressure valve is positioned along the portion of the recirculation line that is separate from the return line.

12. The refrigeration system of claim 1, wherein the refrigeration system includes a normal operating condition where cooled refrigerant from the heat exchanger is provided to every evaporator in the system, and wherein the recirculation line recirculates cooled refrigerant from the heat exchanger to the reservoir when the refrigeration system is in the normal operating condition.

13. The refrigeration system of claim 12, wherein the recirculation line recirculates cooled refrigerant from the heat exchanger to the reservoir when the refrigeration system is in the normal operating condition as well as when the refrigeration system is in a defrost cycle.

14. A method for damping temperature fluctuations in a refrigeration system, the refrigeration system including a compressor, a condenser, a reservoir, a heat exchanger, an expansion device and an evaporator, the method comprising:

compressing a refrigerant at the compressor;

conveying the refrigerant from the compressor to the condenser;

condensing the refrigerant at the condenser;

conveying the refrigerant from the condenser to the reservoir;

conveying the refrigerant from the reservoir to the heat exchanger;

cooling the refrigerant at the heat exchanger to provide a cooled refrigerant;

recirculating a first portion of the cooled refrigerant back to the reservoir; and conveying a second portion of the cooled refrigerant through the expansion device and the evaporator to the compressor.

15. The method of claim 14, further comprising mixing the first portion of cooled refrigerant with refrigerant from the condenser to provide pre-cooled refrigerant.

16. The method of claim 15, wherein the pre-cooled refrigerant is conveyed to the heat exchanger where the pre-cooled refrigerant is further cooled.

17. The method of claim 14, wherein the first portion of cooled refrigerant is recirculated back to the reservoir when the refrigeration system is in a normal operating condition.

18. The method of claim 14, wherein the first portion of cooled refrigerant is recirculated back to the reservoir when the refrigeration system is in a normal operating condition as well as when the refrigeration system is in a defrost cycle.

19. A method for damping temperature fluctuations in a refrigeration system, the method comprising:

condensing a refrigerant at a condensing location to provide a condensed refrigerant;

conveying the condensed refrigerant to a cooling location;

cooling the condensed refrigerant at the cooling location to provide a cooled refrigerant; and recirculating at least a first portion of the cooled refrigerant back through the cooling location.

20. The method of claim 19, further comprising evaporating a second portion of the cooled refrigerant.

21. The method of claim 20, wherein the first portion of cooled refrigerant is recirculated though the cooling location by conveying the first portion of cooled refrigerant to a location upstream from the cooling location, and by mixing the first portion of cooled refrigerant with the condensed refrigerant from the condensing location to provide a pre-cooled, condensed refrigerant that is conveyed through the cooling location.

22. The method of claim 21, further comprising storing the pre-cooled, condensed refrigerant in a reservoir prior to conveying the pre-cooled, condensed refrigerant though the cooling location.

* * * * *